United States Patent [19]

Meinke et al.

[11] 4,095,228

[45] June 13, 1978

[54] WINDSHIELD ANTENNA DEFROSTER COMBINATION WITH RADIO INTERFERENCE REDUCTION

[75] Inventors: Hans Heinrich Meinke, Gauting; Heinz Lindenmeier, Planegg; Friedrich Landstorfer, Munich; Gerhard Flachenecker, Ottobrunn; Jochen Hopf, Garching, all of Germany

[73] Assignee: Hans Kolbe & Co., Bad Salzdetfurth, Germany

[21] Appl. No.: 743,466

[22] Filed: Nov. 18, 1976

[30] Foreign Application Priority Data

Nov. 20, 1975 Germany ..... 2552049

[51] Int. Cl.[2] ..... H01Q 1/02; H01Q 1/32

[52] U.S. Cl. ..... 343/704; 343/712; 219/203; 219/522

[58] Field of Search ..... 343/704, 712, 713; 219/203, 522; 338/61, 62, 63

[56] References Cited

U.S. PATENT DOCUMENTS

| | | | |
|---|---|---|---|
| 3,727,166 | 4/1973 | Kobayashi | 338/63 |
| 3,971,029 | 7/1976 | Torii et al. | 343/704 |
| 4,003,056 | 1/1977 | Davis | 343/704 |

FOREIGN PATENT DOCUMENTS

| | | | |
|---|---|---|---|
| 647,665 | 12/1950 | United Kingdom | 343/705 |

*Primary Examiner*—Eli Lieberman
*Attorney, Agent, or Firm*—Michael J. Striker

[57] ABSTRACT

An automotive vehicle has a window and a vehicle body. A window heater includes an arrangement of heating conductor sections provided on the window. A radio receiving antenna is located in the vicinity of the heating conductor sections. The heating conductor sections are comprised of at least two heating conductor sections together forming a bifilar conductor section group. The two heating conductor sections of each bifilar conductor section group are arranged approximately parallel and closely spaced to each other. The heating conductor sections are so interconnected that the heating current flowing through one of the sections of each group also flows through the other section of the group but in the opposite direction.

5 Claims, 6 Drawing Figures

WINDSHIELD ANTENNA DEFROSTER COMBINATION WITH RADIO INTERFERENCE REDUCTION

BACKGROUND OF THE INVENTION

The invention relates to an arrangement for reducing the effect of radio interference upon a receiving antenna provided upon the windshield of an automotive vehicle when the windshield is also provided with heating conductors arranged in the vicinity of the antenna.

It is known that such heating conductors produce high-frequency interference fields in their general vicinity, due to the fact that they conduct not only heating current but also interference currents. These interference currents are generated, for example, as a result of the operation of the ignition system of the engine of the vehicle, and are transmitted via the current supply lines of the vehicle's electrical system into the heating conductors on the windshield or rear window.

This problem will be explained with reference to the schematic depiction in FIG. 1. FIG. 1 depicts a glass pane, such as a windshield or rear window of a vehicle, in a window frame 2. The heating conductors form upon the window 1 a layer 3 made up of a single continuous and substantially transparent conductor, or made up of a plurality of discrete conductors. The conductor 3 carries current which results in the establishment of a magnetic field having field lines H. At a certain distance away from the conductive layer 3 the shape of the field is substantially as indicated in FIG. 1, and this field includes as constituent components the radio interference fields referred to above. If for example the receiving antenna is constituted by a conductor 4, the magnetic interference fields surrounding the conductor 4 induce interference voltages in the antenna conductor. Also emanating from the heating conductor layer 3 are electrical field lines E which have approximately the shape shown in FIG. 1 and likewise include interference fields as constituent components. Where the field lines of these interfering electrical fields intersect the antenna conductor 4, the displacement currents associated with these electrical fields will induce interference currents in the receiving antenna.

Accordingly, the interference fields from the heating conductors will interfere with the reception of high-frequency signals by the vehicle antenna, if the antenna is located in the vicinity of the heating conductors. This is the case to a particularly significant extent, for example, when the rear window of the vehicle is provided with both a large heating conductor system and also with receiving antenna conductors.

It is known to counteract this difficulty by providing filters in the supply lines for the heating conductor, for example choke coils for reducing interference currents in the heating conductors. However, this known expedient is effective only at relatively high frequencies and only over very limited bandwidths.

SUMMARY OF THE INVENTION

It is a general object of the invention to reduce the effect of the interference fields upon the receiving antenna over very large frequency ranges and even at relatively low frequencies, e.g., those associated with radio reception.

This object can be met according to one advantageous concept of the invention by using for the window heater a plurality of heating conductor sections. The heating conductor sections are arranged in groups of two together constituting a bifilar conductor section group. The two heating conductor sections of each bifilar conductor section group are arranged approximately parallel and closely spaced to each other. The heating conductor sections are so interconnected that the heating current flowing through one of the sections of each group also flows through the other section of the group but in the opposite direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
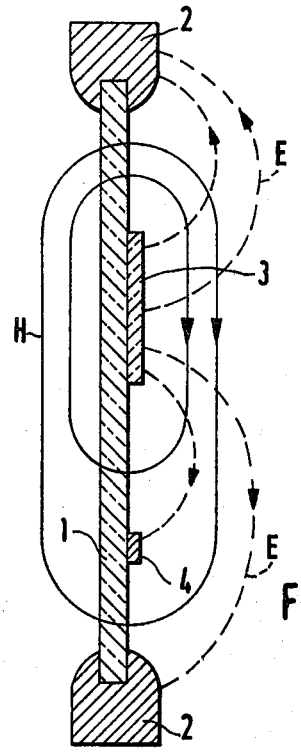
FIG. 1 depicts a heating conductor arrangement and an antenna conductor arrangement both provided in the windshield or rear window of an automotive vehicle, showing how the interference fields emanating from the heating conductors interfere with radio reception.
Figure 2:
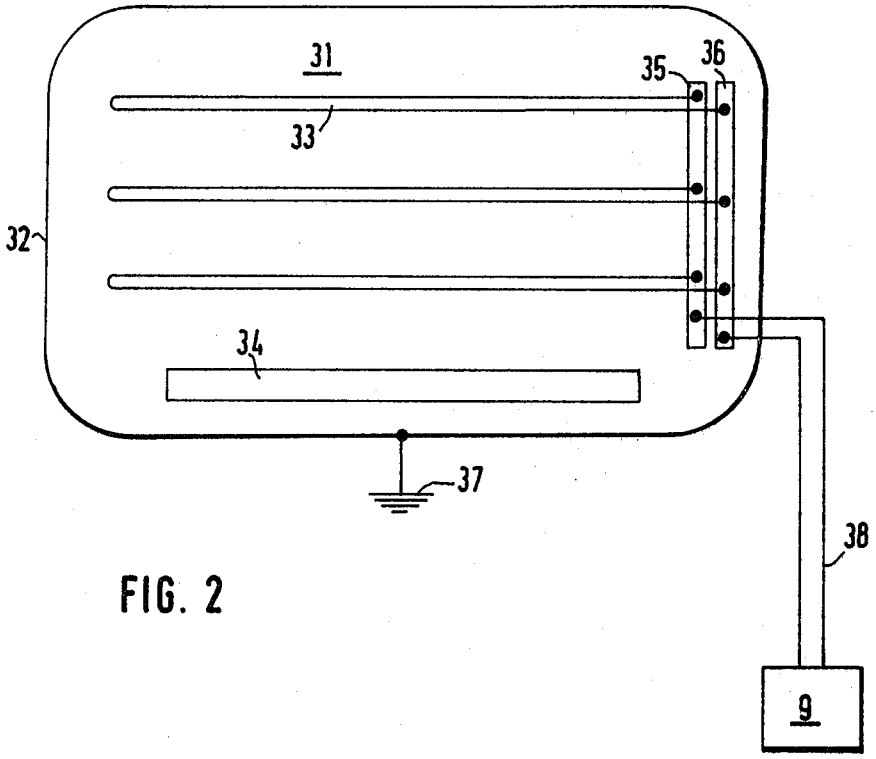
FIGS. 2–5 depict four embodiments of the inventive concept.
Figure 3:
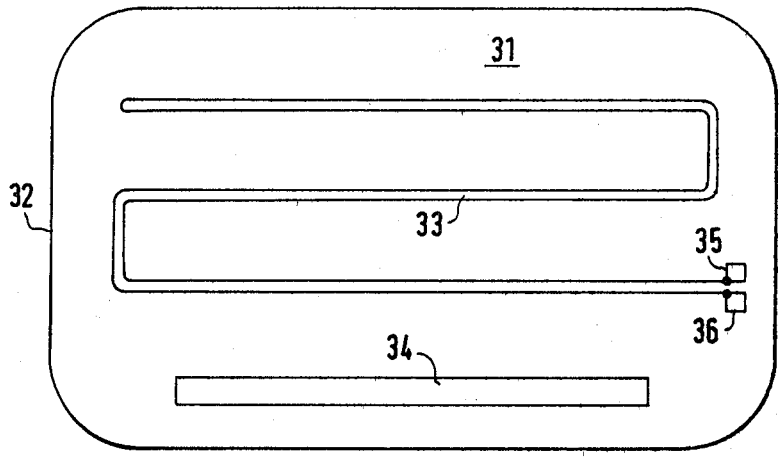
Figure 4:
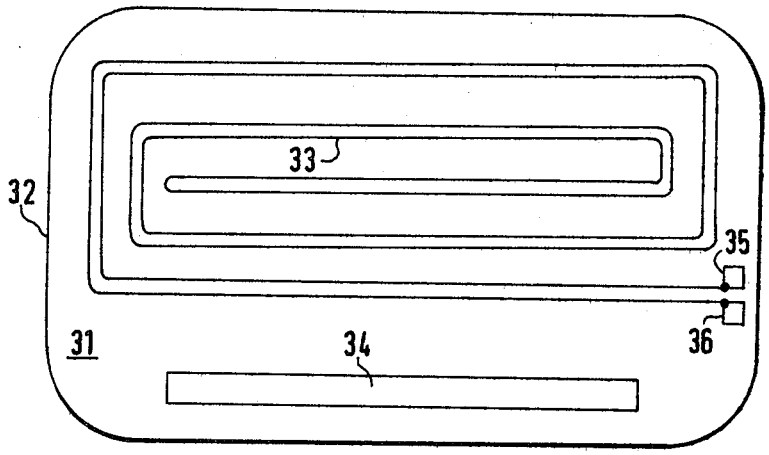

FIGS. 2–4 depict a glass pane 31 mounted in a window frame 32. The heating conductors form a conductive layer on the glass made up of one or a plurality of individual conductors 33. The conductors 33 are surrounded by magnetic field lines H which include as constituent components the interference fields under discussion. If the receiving antenna is a conductor 34 located on or in the vicinity of the window glass, the magnetic interference fields associated with the heating conductors 33 induce interference voltages in the antenna. The ends of the heating conductors 33 are connected to conductive connector lines 35, 36 which are fed with heating current from battery 9 through supply lines 38.

According to an advantageous concept of the invention, each heating conductor is bifilar and so designed that the heating current of one heating conductor, or of one heating conductor section, is fed into another approximately parallel, closely neighboring heating conductor or conductor section, with the current in the neighboring conductors or sections being opposed.

When two opposed and equal currents flow in closely neighboring conductors, the resultant magnetic field will be concentrated in the space intermediate the conductors, with the space surrounding the two conductors containing only a weak magnetic field. The production of such interference-reducing currents in the conductors 5 is made possible by the so-called neighboring effect, described for example in H. Meinke, "Einfuehrung in die Elektrotechnik hoeherer Frequenzen," volume 1, second edition, Berlin, 1965, pages 21 and 22 and section 17.

FIG. 2 depicts an embodiment in which a plurality of bifilar heating conductors are connected to a common connector line, here designed as a conductive strip.

FIG. 3 depicts a single bifilar heating conductor 33 which is of meandering configuration and extends over the surface to be heated. The ends of conductor 33 are connected to connector lines 35 and 36. FIG. 4 depicts a bifilar heating conductor 33 which extends in a spiral over the surface to be heated. The surface to be heated could be provided with a plurality of such spiraling or meandering heating conductors.

When a plurality of bifilar heating conductors are employed, it is advantageous to connect corresponding first ends of the bifilar conductors to one common connector line 35, and corresponding second ends of the bifilar conductors to a difference common connector line 36, as shown in FIG. 2. However, in that case, one cannot avoid having one end of each heating conductor crossing over the common connector line 35 of the opposite ends of the heating conductors, so that such heating conductor ends must be electrically insulated at these crossover points. For that reason, the conductor configuration shown in FIG. 2 cannot be impressed as a single unit directly onto the windshield 31. Therefore, according to a further advantageous concept of the invention, the crossover problem is dealt with as shown in FIG. 5.

Figure 5:
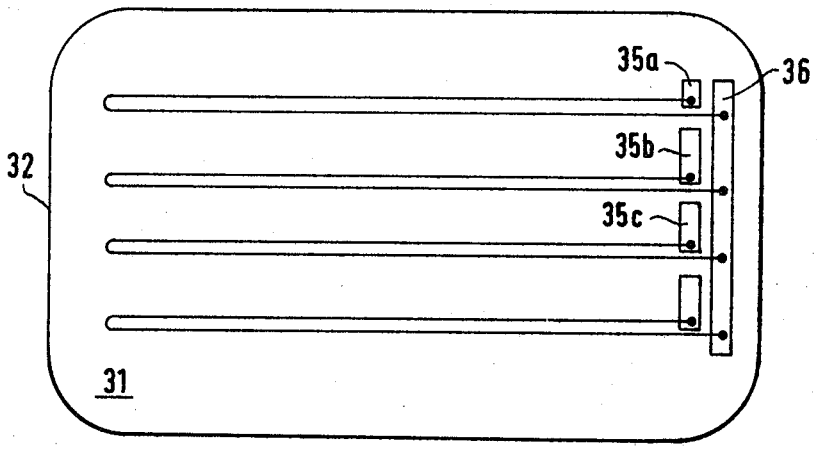

In FIG. 5, only one end of each bifilar heating conductor is connected to a common, continuous connector strip 36. The second end of each bifilar heating conductor is connected to a respective one of a plurality of discrete electrical connector surfaces 35*a*, 35*b*, 35*c*. These discrete connector surfaces are then connected one to the next by means of conductive bridging connectors insulated from the heating conductors 33.

Figure 6:
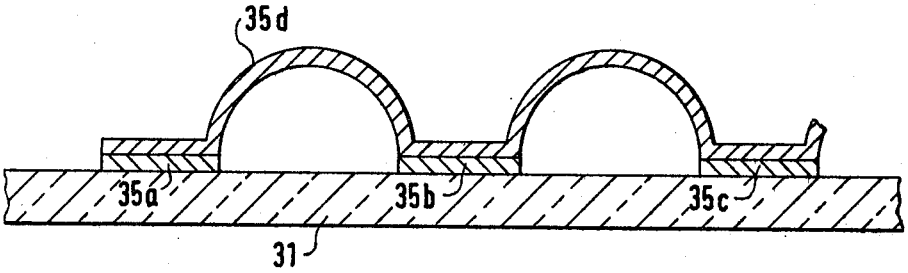
FIG. 6 depicts a construction which can be used for effecting the electrical connections necessary in the embodiment of FIG. 5.

In the embodiment of FIG. 6, all of these bridging connectors are parts of a single conductive connector 35*d*. Connector 35*d* is made up of a plurality of bent out bridge-shaped sections alternating with planar sections lying in a common plane. The planar sections are so arranged as to line up with the conductive connector sections 35*a*, 35*b*, 35*c* and be electrically connected to the latter. This makes for a very simple and mechanically stable assembly for the bridging connectors.

It will be understood that each of the elements described above, or two or more together, may also find a useful application in other types of circuits and constructions differing from the types described above.

While the invention has been illustrated and described as embodied in expedients for suppressing the effect upon automotive vehicle antennas of the fields produced by the flow of heating currents in windshield heaters and the like, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an automotive vehicle having a window and havng a vehicle body, in combination, a window heater comprising an arrangement of heating conductor sections provided on the window; and a radio receiving antenna located in the vicinity of the heating conductor sections, the heating conductor sections being comprised of at least two heating conductor sections together forming a bifilar conductor section group, the two heating conductor sections of each bifilar conductor section group being arranged approximately parallel and closely spaced to each other, the heating conductor sections being so interconnected that the heating current flowing through one of the sections of each group also flows through the other section of the group but in the opposite direction.

2. The combination defined in claim 1, the window heater being comprised of a plurality of such bifilar heating conductor section groups, the heating conductor sections being sections of a longer meandering bifilar conductor which meanders over the window surface to be heated.

3. The combination defined in claim 1, the window heater being comprised of a plurality of such bifilar heating conductor section groups, the heating conductor sections being sections of a longer bifilar conductor which extends over the window surface to be heated in a spiral path.

4. The combination defined in claim 1, the window heater further including a single continuous first contact strip and a plurality of discrete spaced apart second contact strip sections, one end of each conductor section group being conductively connected to respective portions of the continuous first contact strip, the other end of each conductor section group being conductively connected to a respective one of the discrete second contact strip sections, further including electrically conductive means insulated from said one end of each conductor section group and conductively connecting together said discrete second contact strip sections.

5. The combination defined in claim 4, the electrically conductive means being a single element having flat portions lying in conductive contact with the second contact strip sections and having bridging portions alternating with the flat portions, the bridging portions being shaped to avoid conductive contact with the ends of the conductor section groups connected to the first contact strip.

* * * * *